United States Patent [19]

Suzuki et al.

[11] Patent Number: 4,840,829

[45] Date of Patent: Jun. 20, 1989

[54] NONWOVEN FABRIC PATTERNED WITH APERTURES

[75] Inventors: Migaku Suzuki, Kawanoe; Satoshi Nozaki, Ehime; Shigeo Imai, Kawanoe; Makoto Ishigami, Kawanoe; Toshio Kobayashi, Kawanoe, all of Japan

[73] Assignee: Uni-Charm Corporation, Ehime, Japan

[21] Appl. No.: 138,945

[22] Filed: Dec. 29, 1987

[30] Foreign Application Priority Data

Dec. 31, 1986 [JP] Japan ..... 61-312896

[51] Int. Cl.[4] ..... B32B 3/10

[52] U.S. Cl. ..... 428/131; 428/224; 428/283; 428/288

[58] Field of Search ..... 428/131, 224, 283, 288

[56] References Cited

U.S. PATENT DOCUMENTS 4,608,292 8/1986 Lassen ..... 428/131

4,701,237 10/1987 Lassen ..... 428/131

*Primary Examiner*—Marion C. McCamish

*Attorney, Agent, or Firm*—Fred Philpitt

[57] ABSTRACT

A nonwoven fabric patterned with apertures comprising nonwoven fabric areas into which individual fibers are gathered and entangled together and continuously from which said fibers are branched, and circular or elliptical apertures defined by said areas in a regular pattern. Such nonwoven fabric is produced by treating a fibrous web on a support having thereon a plurality of projections distributed at predetermined intervals with a high speed water jet.

5 Claims, 4 Drawing Sheets

NONWOVEN FABRIC PATTERNED WITH APERTURES

BACKGROUND OF THE INVENTION

The present invention relates to a nonwoven fabric patterned with apertures and, more particularly, to a nonwoven fabric patterned with regularly distributed apertures having individual fibers reoriented and entangled together by treating a layer of fibrous material with a high speed water jet.

It is well known to treat a layer of fibrous material (fibrous web) with a high speed fluid jet so as to reorient and distribute individual fibers to form nonwoven fabrics patterned with regularly distributed apertures as disclosed, for example, in Japanese Patent Publications No. 44-23909, U.S. Pat. No. 2,862,251 and U.S. Pat. No. 3,240,657.

In the nonwoven fabric disclosed in Japanese Patent Publication No. 44-23909, relatively many fiber fluffs remain in each of the apertures defined by nonwoven fiber areas, making a contour of this aperture unclear and these nonwoven fiber areas are rope-like without sufficient smoothness. As a consequence, the nonwoven fabric of this prior art is not agreeable to the touch.

The nonwoven fabric disclosed by U.S. Pat. No. 2,862,251 and U.S. Pat. No. 3,240,657 is disadvantageous in that the apertures are not clearly contoured and said nonwoven fiber areas have protuberances which inconveniently limit the nonwoven fabric to a special application. Furthermore, the fiber entangling degree is different in the edges of the respective apertures and in poor surface smoothness the areas defined between these edges, resulting in lower tensile and rupture strengths which inevitably require, in turn, addition of any suitable binder.

It should be noted that these problems are due to the particular techniques employed to form these nonwoven fabrics. More specifically, the former technique is to treat the fibrous web placed on the mesh support with a high speed water jet so that the individual fibers are forced aside under the action of said water jet on the respective intersections (knuckles) at which the component wire material of said support intersects with one another and thereby the apertures are formed. According to this technique, however, the fibers partially project through the apertures (meshes) of said support and partially entangle on said intersections. These fibers are broken as the nonwoven fabric is peeled off from said support upon completion of the treatment and remain as fluffs which make the apertures unclearly contoured. The latter technique, on the other hand, is to interpose the fibrous web between the first support patterned with apertures and having a curved inner surface and the second support of meshes and then to treat said web with the high speed water jet delivered from the side of said first support so that the apertures are formed by displacement of the fibers on the path of the water jet as this water jet forces these fibers aside. According to this technique, the fibers are gathered together to protrude the edges of the respective apertures and, as a result, the fiber is higher than entangling degree is higher in the edges thereof the areas defined between said edges of the respective apertures. Said problem is due to such a fact.

A principal object of the present invention is to provide improved nonwoven fabric having a smooth surface throughout the width of each nonwoven fiber area defined between the apertures, said apertures clearly contoured a strength requiring no addition of binder, soft and agreeable touch and excellent drape characteristics.

SUMMARY OF THE INVENTION

To resolve the problems set forth above, the present invention resides in a nonwoven fabric comprising nonwoven fiber areas into which individual fibers are gathered and entangled together and continuously from which said fibers are branched, and circular or elliptical apertures defined by said areas in a regular pattern, characterized by that each of said nonwoven fiber areas has a substantially uniform fiber density and a smooth surface; that each of said apertures has an inner periphery definitely contoured; and that said apertures are spaced at least 1 mm from one another.

The nonwoven fabric according to the present invention is patterned with the apertures more clearly contoured than in the nonwoven fabric of the prior art, has the uniform strength, surface smoothness and softness throughout the overall areas and, as a consequence, is superior in its touch and drape characteristics. Accordingly, the nonwoven fabric according to the present invention is useful for a variety of applications, and optimum particularly as surface material for the absorptive sanitary goods such as disposable diapers and sanitary napkins.

PREFERRED EMBODIMENTS

The present invention will be described, by way of example, in reference with the accompanying drawings.

Figure 1:
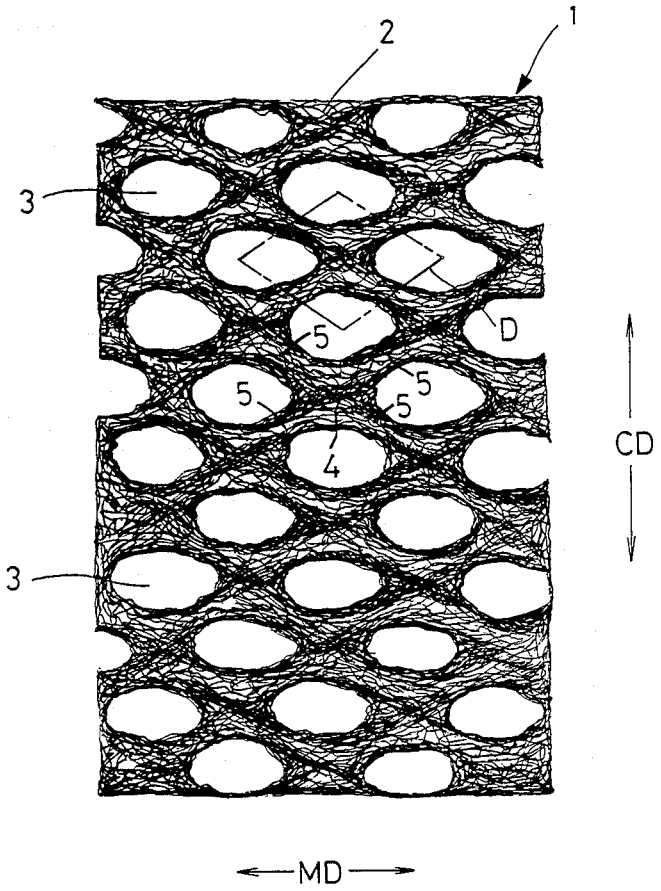
FIG. 1 is a schematic diagram illustrating the nonwoven fabric of the present invention is an enlarged scale.

Referring to FIG. 1, a nonwoven fabric 1 is maintained in a sheet-like configuration merely by individual fibers being gathered together and entangled in random directions without use of any binder, and comprises nonwoven fiber areas 2 in which said individual fibers are continuously gathered and then branched, and elliptical (or circular) apertures 3 regularly defined by said areas 2. Each of the nonwoven fiber areas 2 is substantially uniform in its fiber density and has a smooth surface. The expression "smooth" used herein means that the area 2 substantially has neither difference in its height, i.e., thickness nor unevenness not only throughout the area but also over any portion thereof. When observed with the naked eyes, each of the apertures 3 presents substantially no fiber bridge or fluff diametrically extending thereinto or thereacross and is therefore clearly contoured.

In association with each of the nonwoven fiber areas 2, the adjacent four of said apertures 3 are located so as to define a diamond-shape D in which a region 4 extending between each pair lengthwise (MD) and widthwise (CD) adjacent apertures 3 is larger than a region 5 extending between each pair of obliquely adjacent apertures 3 as viewed in FIG. 1. As indicated by relatively dark zones in FIG. 1, the fibers partially extend in the oblique directions to intersect together centrally of said larger region 4 in a X-shape and partially extend the edges of the apertures 3 which are adjacent to each other widthwise of the nonwoven fabric 1. More specifically, the fibers extending lengthwise of the nonwoven fabric 1 partially intersect together in the region(s) defined between at least two, preferably three or more apertures 3 being arranged lengthwise of the nonwoven fabric 1 and extend along the edges of these apertures 3 adjacent to each other widthwise of the nonwoven fabric 1, defining these edges. The fibers extending along and contouring these edges are continuous with the fibers contouring the edges of the apertures 3 adjacent to one another lengthwise of the nonwoven fabric 1. As has previously been mentioned, the fiber density in each of the nonwoven fiber areas 2 is substantially uniform, and the fibers directly contouring each of the apertures 3 are distributed with further high fiber density and degree of entangling. Such unique orientation of the fibers largely contributes to the clear contouring of the apertures 3 and improves the strength of the nonwoven fabric 1 as a whole, inclusive of the shape-stability of the apertures 3.

A distance between each pair of the adjacent apertures 3, i.e., the width of the nonwoven fiber area 2 should be at least 1 mm and, when it is less than 1 mm, this nonwoven fiber area 2 would become rope-like and the nonwoven fabric could not have a smooth surface as that obtained in accordance with the technique disclosed by said Japanese Patent Publication No. 44-23909. The pitch of the apertures 3 should be at least 2.5 mm and a diameter thereof should be at least 1 mm. When less than these thresholds, respectively, it would be impossible to form a clear contour of the apertures 3 and, even if such a clear contour is obtained, entangling of the fibers may be loosened during handling or using the nonwoven fabric, resulting in loss of the clear contouring.

Although not critical, the basic weight of the nonwoven fabric 1 is less than 50 g/m$^2$, preferably less than 120 g/m$^2$ to obtain the apertures 3 having a clear contour and when it is less than 10 g/m$^2$, the nonwoven fabric 1 would be too thin to achieve the desired strength and the fiber density would be too uneven to obtain the apertures 3 having clear contour.

The fiber material of the nonwoven fabric 1 is also not critical and may be any one of those which have usually been used as materials for the nonwoven or woven fabric. However, a nonwoven fabric made of hydrophobic fiber such as polyester or polypropylene fiber or hydrophilic fiber such as rayon which has been subjected to the water repellent treatment in accordance with the present invention can provide the optimum surface material for absorptive sanitary goods having a high liquid permeability due to the clearly contoured apertures 3 and a agreeable touch for the user's skin due to the smooth surface as well as the softness. Although also not critical, the component fiber preferably has a length of 20 to 100 mm and a fineness of 0.5 to 15 deniers.

The nonwoven fabric thus obtained in accordance with the present invention is useful for a variety of applications, for example, clothing material, decorative and covering fabric for various items inclusive of furnitures, interior finishing for wall and filter material, as well as surface material for absorptive sanitary goods such as disposable diapers and sanitary napkins.

The nonwoven fabric according to the present invention can be made in a manner as will be described hereinafter.

Figure 2:
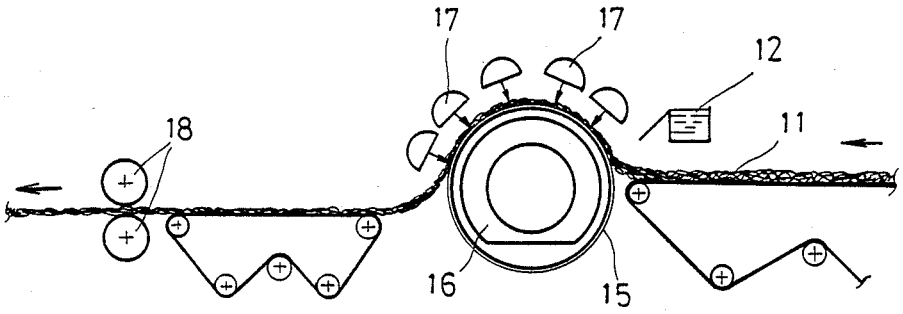
FIG. 2 is a side view illustrating an apparatus for making the nonwoven fabric of the present invention.
Figure 3:
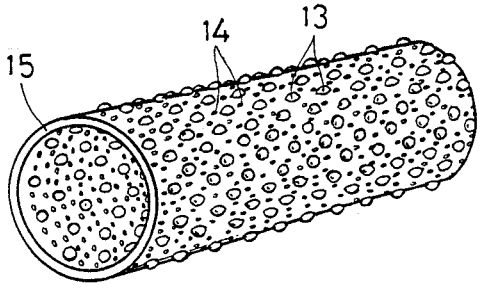
FIG. 3 is a perspective view illustrating a support cylinder used in the apparatus.
Figure 4:
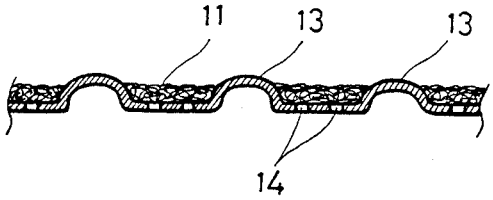
FIG. 4 is a sectional view illustrating the manner in which the fibers are forced aside on the respective projections distributed on said support cylinder.

As shown by FIGS. 2 through 4, a layer of fibrous material, preferably fibrous web 11 delivered from a card, in which individual fibers are adapted to be displaced under an effect of high speed water jet is supplied from a reservoir 12 with water screen so as to reduce inter-fiber voids, preventing the fibers from becoming fluffy, and thereby to achieve a desired shape-stability. Then the web 11 is guided to a support cylinder 15 having thereon a plurality of projections 13 distributed at predetermined intervals, preferably spaced at least 1 mm one from another, in the previously mentioned diamond-shapes and a plurality of small drainage holes 14 provided between said projections. Suction means 16 mounted within said cylinder 15 promotes drainage through said drainage holes 14 while a nozzle assembly 17 comprising a plurality of nozzles each having a predetermined diameter and arranged transversely at a predetermined pitch delivers to the web 11 from above the high speed water jet. This water jet treatment forces the fibers from the respective projections 13 aside towards the area defined therebetween, forming said apertures 3 and simultaneously causing the fibers to be entangled together. In this manner, the water jet effectively forces the fibers aside, in cooperation with the respective projections 13, into the flat area defined therebetween on the cylinder 15 while forcing the fibers to be entangled together. Furthermore, as has previously been described, the fibers partially intersect together in front and behind the respective apertures 3 and extend along the edges of these apertures 3. As a consequence, said apertures 3 are as clear as if they have been stamped or punched out and clearly contoured. The nonwoven fabric thus provided with the apertures and the fiber entangling is then introduced between a pair of squeeze rollers 18 by which excessive moisture is removed and transferred to the subsequent drying and take-up processes.

EXAMPLE

Figure 5:
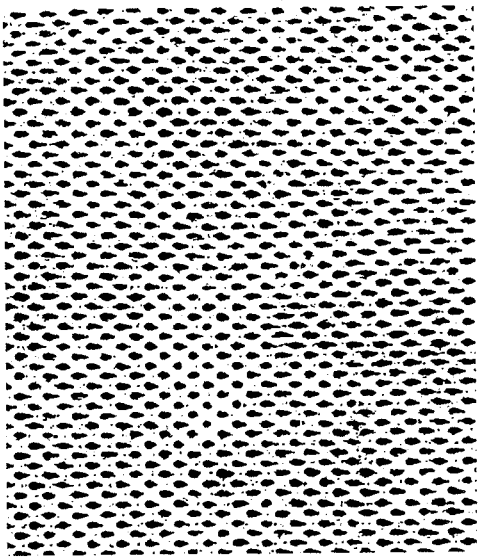
FIG. 5 is a photographic plan view showing the nonwoven fabric of the present invention in real scale.
Figure 6:
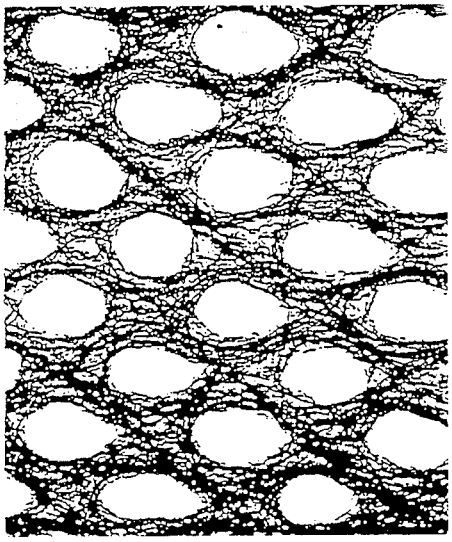
FIG. 6 is a photographic plan view showing a part of the nonwoven fabric shown by FIG. 5 in an enlarged scale.

Utilizing the apparatus as shown by FIG. 2 together with the support cylinder as shown by FIG. 3, 100% polyester fiber web having a basic weight of 30 g/m$^2$ was treated with column-like water jet at a pressure of 70 kg/cm$^2$ and a flow delivery of 9.5 $\lambda$/m$^2$ to obtain the nonwoven fabric patterned with apertures as shown by FIGS. 5 and 6 at a production rate of 70 m/min. A nozzle assembly was employed, that included a plurality of nozzles each having an orifice diameter of 130 $\mu$ and arranged at 1 mm pitch.

As the support, a seamless cylinder having a diameter of 500 mm formed by the nickel-electro-forming technique was employed. This cylinder was provided on its surface with a plurality of generally semi-spherical projections each having diameter of 2 mm and a height of 0.8 mm, these projections being regularly distributed so as to occupy 35% of the surface area of said cylinder and a flat surface extending between said projections so as to occupy 9% of the surface area of said cylinder.

COMPARATIVE EXAMPLE 1

Figure 7:
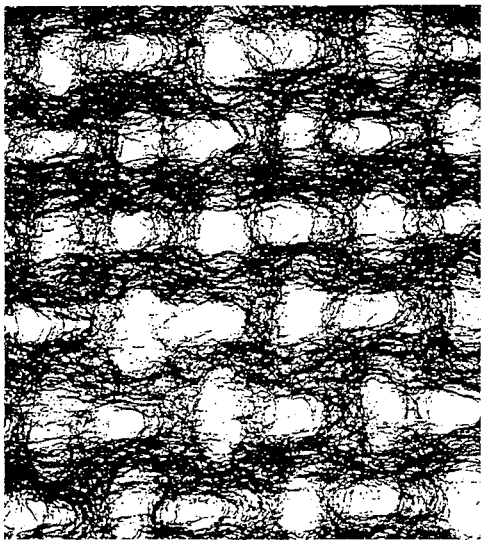
FIG. 7 is a photographic plan view showing a part of the nonwoven fabric obtained in Comparative Example 1 in an enlarged scale.

The web was treated in the same manner as the example except that the support cylinder was replaced by an endless belt made of plain weave 10 meshes, and thereby a nonwoven fabric patterned with apertures as shown by FIG. 7 was obtained.

COMPARATIVE EXAMPLE 2

Figure 8:
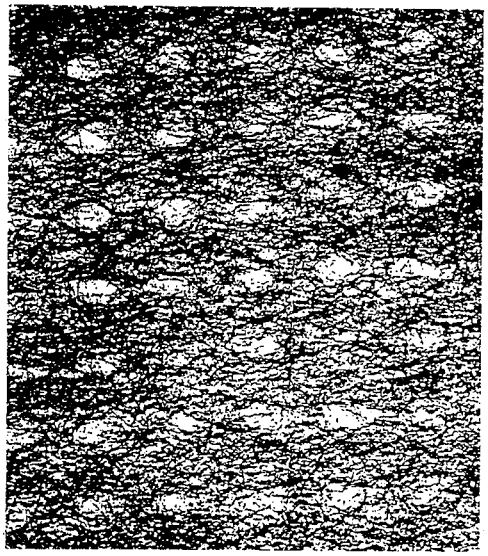
FIG. 8 is a photographic plan view showing a part of the nonwoven fabric obtained in Comparative Example 2 in an enlarged scale.

The web was treated in the same manner as the example except that the support cylinder as shown be FIG. 3 was replaced by an endless belt of satin weave 76 meshes surrounded, with interposition of a space in which the fibrous web can travel, by a seamless cylinder having a diameter of 380 mm, said cylinger being formed by the nickel-electro-forming technique and having a plurality of through-holes each 2 mm $\phi$ regularly distrubuted in the peripheral surface of said cylinder, and the web was treated with a water screen jet delivered from inside of said endless belt at a pressure of 15 kg/cm$^2$ and a flow delivery of 30 $\lambda$/m$^2$ as to achieve a production rate of 10 m/min, and thereby a nonwoven fabric patterned with apertures as shown by FIG. 8 was obtained.

The nonwoven fabric patterned with apertures obtained in said example and Comparative Examples 1, 2 respectively exhibited characteristics as following:

| | Basic Weight (g/m$^2$) | Thickness (mm) | Tensile Strength (g/5 cm width) MD | CD | Aperturing Countour (FIGS. 6, 7, 8) |
|---|---|---|---|---|---|
| EX. | 29.8 | 0.48 | 11019 | 2242 | clear |
| COM. EX. 1 | 30.2 | 0.50 | 6604 | 862 | rather unclear |
| COM. EX. 2 | 29.3 | 0.77 | 73 | 10 | unclear |

What is claimed is:

1. A nonwoven fabric that includes a plurality of spaced apart apertures arranged in a pattern in said fabric, and nonwoven fiber areas composed of individual fibers that are entangled together around said apertures, the improvement comprising that (1) said apertures:

(a) being circular or elliptical in shape, (b) each having a periphery that is definitely contoured and free of fluff, (c) being spaced at least 1 mm from one another, and (d) being formed solely by the action of a water jet against a web of non-woven fibers travelling over a patterned array of upstanding projections that are surrounded by water drainage openings, and (2) said nonwoven fiber areas:

(a) having substantially no difference in thickness throughout its area, (b) having a high fiber density and degree of entangling directly contouring each of the apertures so as to give improved strength and shape-stability, (c) being substantially free of any fluff extending into said apertures, and (d) having a strength requiring no addition of a binder.

2. Nonwoven fabric according to claim 1, wherein adjacent four of said apertures are located so as to define a diamond-shape in which a region extending between each pair of the apertures adjacent to each other lengthwise and widthwise of the nonwoven fabric is larger than a region extending between each pair of the apertures adjacent to each other obliquely of the nonwoven fabric and the fibers partially extend in the oblique directions to intersect together substantially at a center of said larger region and partially extend the edges of the apertures, defining the latter.

3. Nonwoven fabric according to claim 1, wherein a fiber entangling strength is higher in the area in which the fibers obliquely extend to be intersected together and further extend along the edges of the apertures than in the rest area.

4. Nonwoven fabric according to claim 1, wherein said apertures are arranged at a pitch of at least 2.5 mm and each of said apertures has a diameter of at least 1 mm.

5. Nonwoven fabric according to claim 1, wherein said fabric a basic weight is 10 to 150 g/m$^2$.

* * * * *